United States Patent [19]

Baugh et al.

[11] 4,032,183

[45] June 28, 1977

[54] PIPE ELEVATOR

[75] Inventors: John L. Baugh; Hollis A. Baugh, both of Houston, Tex.

[73] Assignee: Brown Oil Tools, Inc., Houston, Tex.

[22] Filed: July 28, 1975

[21] Appl. No.: 599,839

[52] U.S. Cl. ..... 294/91; 214/1 P; 214/2.5; 269/126; 269/237

[51] Int. Cl.[2] ..... B66C 1/42; B66C 1/62

[58] Field of Search ..... 294/90, 91, 86.12; 214/1 P, 1.1, 1.2, 1.3, 1.4, 2.5; 269/237, 126

[56] References Cited

UNITED STATES PATENTS

| | | | |
|---|---|---|---|
| 1,106,130 | 8/1914 | Clinger | 294/91 |
| 1,528,145 | 3/1925 | Davidson | 294/86.12 |
| 1,572,616 | 2/1926 | Mohnkern | 294/91 |
| 3,532,229 | 10/1970 | Scaggs | 214/2.5 |
| 3,779,594 | 12/1973 | Monroe | 294/91 |

FOREIGN PATENTS OR APPLICATIONS

| | | | |
|---|---|---|---|
| 973,065 | 10/1964 | United Kingdom | 294/86.12 |

*Primary Examiner*—Robert S. Ward, Jr.
*Attorney, Agent, or Firm*—Browning, Bushman & Zamecki

[57] ABSTRACT

Disclosed is an elevator for handling pipe with enlarged ends by gripping the end of the pipe with the enlargement between two hinged arm pieces. In the specific embodiment shown, one arm piece fits into the end of the pipe with enlarged end in the form of a collar, and cooperates with a C-shaped receptacle which is fixed to the end of the other arm piece, and which fits around the pipe and catches the pipe collar to prevent the pipe from separating from the first arm inserted into the pipe end. A spring-actuated lock prevents the arms from opening and releasing the pipe.

6 Claims, 11 Drawing Figures

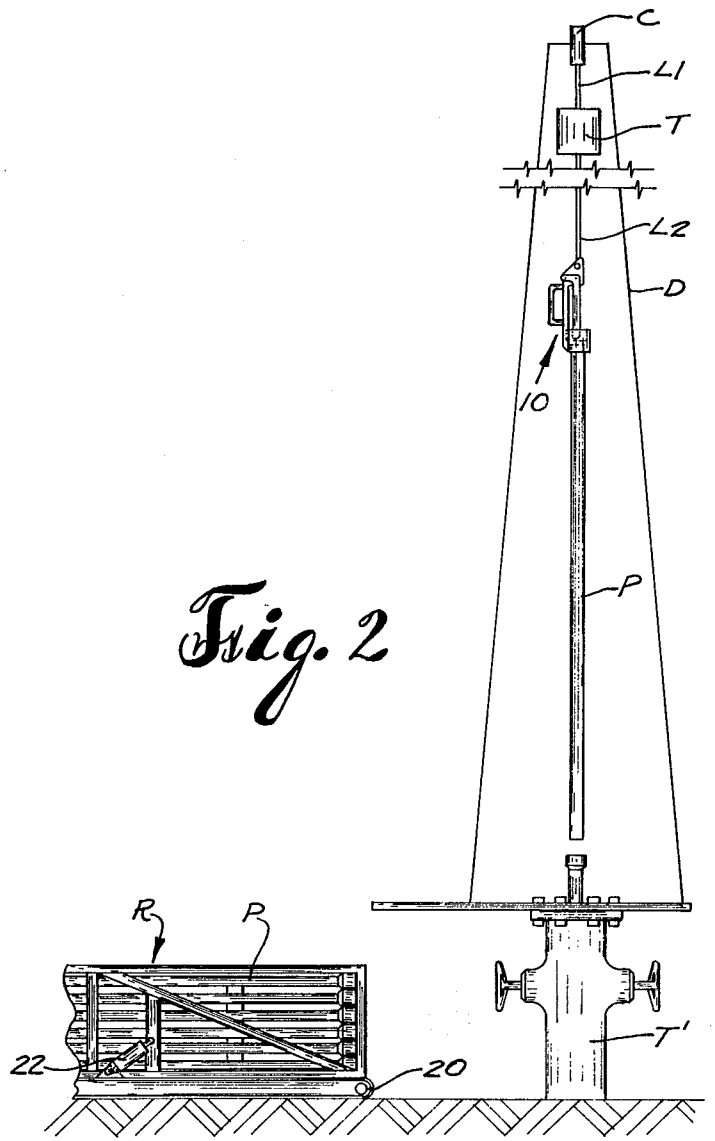
Fig. 2
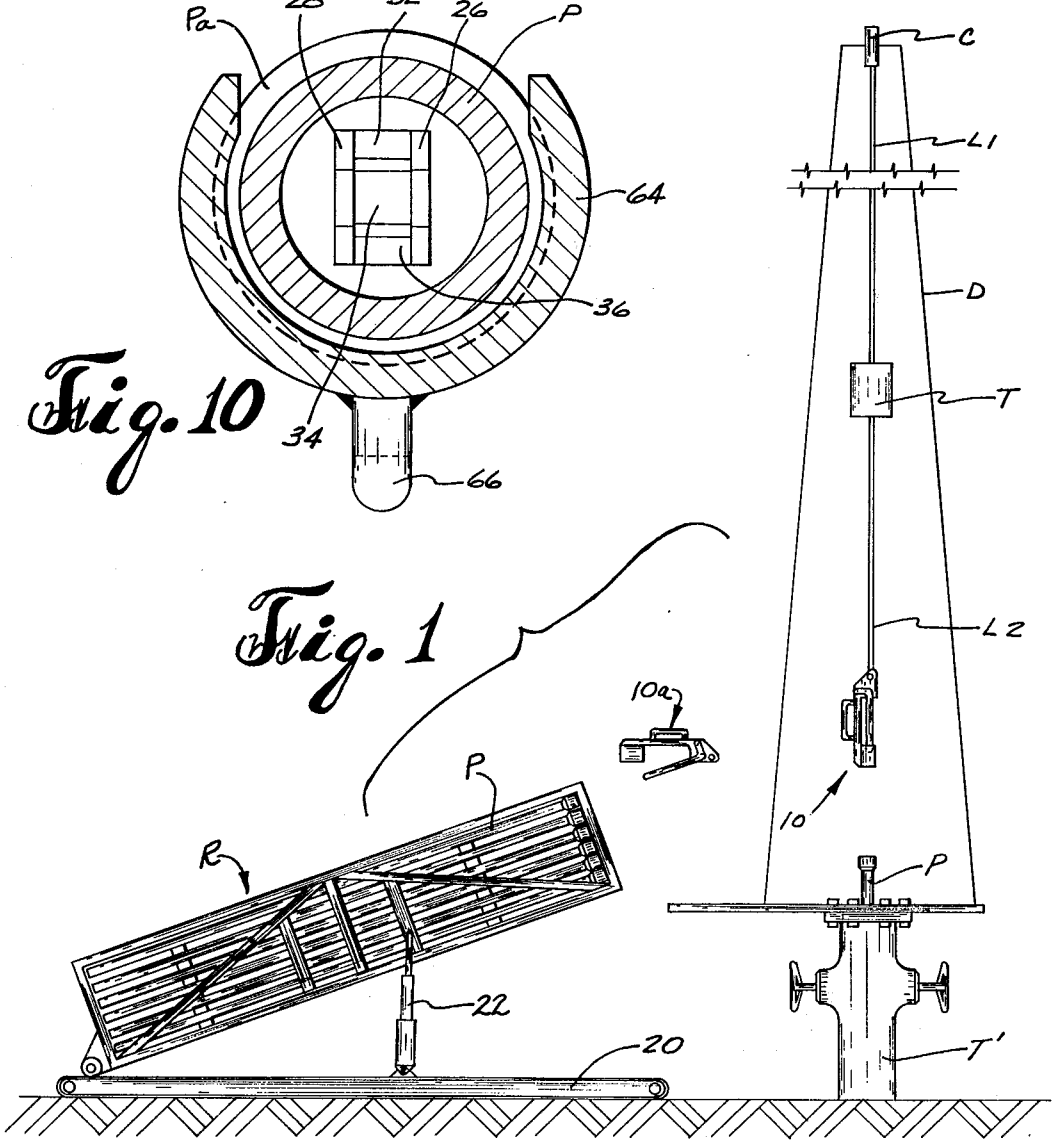
Fig. 1
Fig. 10

PIPE ELEVATOR

BACKGROUND OF THE INVENTION

1. Field of the Invention

The present invention relates to apparatus used to manipulate tubular members. More specifically, the present invention relates to devices, particularly elevators, used to selectively grip and manipulate pipes equipped with enlarged ends.

2. Description of the Prior Art

Various devices for gripping and manipulating pipe members are well known in the prior art, particularly in the field of well drilling and working. In various stages of well operations, for example, it is necessary to raise or lower pipe segments between different levels, to move pipe segments from one storage area to another, and to raise or lower pipe segments out of or into well holes. Elevators are often used to carry out such manipulations. Many such elevators are massive and bulky, cumbersome to transport, and expensive to manufacture. In other cases, sling lines and man-handling are the primary means used to maneuver the pipes. Manual pipe-handling can be difficult and even dangerous, particularly where there is a possibility that a pipe may be dropped. An efficient, inexpensive, and relatively lightweight elevator that is simple to operate would be of considerable advantage in many pipe-handling operations, even when such elevator is supplemented by manhandling.

Summary of the Invention

The apparatus of the present invention is constructed primarily in the form of two arm pieces joined together at one end by a hinge which permits relative movement of the arms in scissors-like fashion between a closed position and an open position. One arm, called the insertion arm, has a shank of small enough lateral dimension to fit into the open enlarged end of a pipe member to be gripped and manipulated, while the other arm, called the cradle arm, is fitted at the end opposite the hinge with a C-shaped receptacle large enough to fit partially around the pipe, but too small for the enlarged end of the pipe to pass through. With the arms in the open position, the insertion arm is inserted into the end of the pipe fitted, for example, with a collar, then the cradle arm is closed down on the pipe and the C-shaped receptacle is fitted around the pipe with the pipe collar positioned between the C-shaped receptacle and the hinged ends of the arms. The pipe collar is thus caught by the C-shaped receptacle, and the insertion arm is unable to be completely withdrawn from within the pipe end. A locking device is actuated by a spring to lock the arms in the closed position. A cable or other appropriate device may be attached to the hinge end of the cradle arm to lift the pipe by means of the elevator. To release the pipe from the elevator, the locking device is manually operated to unlock the arms from the closed position, and the C-shaped receptacle is withdrawn from the pipe, allowing the insertion arm of the elevator to slip out of the end of the pipe. Although a pipe collar is specifically discussed, the receptacle of the elevator may be constructed to accommodate any enlarged end of a pipe member, whether integral to the pipe member, or attached thereto.

BRIEF DESCRIPTION OF THE DRAWINGS

FIG. 1 is a partially schematic elevation showing the use of the elevator of the present invention in a workover rig on a well;

FIG. 2 is another partially schematic elevation of the workover rig shown in FIG. 1, showing a pipe segment suspended by the elevator;

FIG. 10 is a view along the line 10—10 in FIG. 3.

DESCRIPTION OF A PREFERRED EMBODIMENT

In FIGS. 1 and 2, the elevator of the present invention is shown generally at 10 being employed to manipulate pipe in a workover rig on a well. A derrick D of the workover rig sits atop a Christmas tree T capping the well. A cable L1 passes over a crown block C at the top of the derrick D, and supports a traveling block T. The elevator at 10 is suspended from the traveling block T by a second cable L2. Pipe members P are stored in a pipe rack shown generally at R. In FIG. 1, the pipe rack at R is shown in an elevated position, supported on a skid mount 20 by a fluid pressure piston-and-cylinder assembly 22. In FIG. 2 the pipe rack at R is shown in a horizontal position, with the piston-and-cylinder assembly 22 in a retracted condition.

In FIG. 1, the elevator at 10 is shown in a closed position, discussed in detail hereinafter, suspended by the cable L2 above a pipe segment P positioned in the well. The elevator is also inserted in FIG. 1 at 10*a* in an open position, discussed in detail hereinafter, outside the derrick D, ready to be attached to a pipe P in the pipe rack at R. In FIG. 2, the elevator at 10 is shown supporting a pipe member P above the well. In the operation of making up a pipe string and drilling in the well, the elevator at 10 may be used in transporting pipe from the pipe rack at R to the position shown in FIG. 2, and lowering the pipe segments down into the well. As each successive pipe segment P is positioned in the derrick D, it may be threaded to the preceding one in the well, and drilling operations continued with the use of a drilling snubber (not shown). The operation is reversed in withdrawing the pipe string from the well, with each threaded pipe joint emerging from the christmas tree T being broken, and each successive pipe segment P being raised by the elevator at 10 and transferred to the pipe rack at R. From the description of the construction and operation of the elevator at 10 given hereinafter, it will be appreciated that a pipe segment P suspended by the elevator at 10 as shown in FIG. 2 may be rotated with respect to the derrick D to make up or break out a threaded joint without interference from the attachment of the elevator to the pipe segment. In addition to the elevator at 10 turning on the cable L2, the pipe member P may be rotated about its longitudinal axis with respect to the elevator without loosening the grip the elevator has on the pipe member. A swivel may also be used in suspending the elevator for added rotational flexibility.

Figure 4:
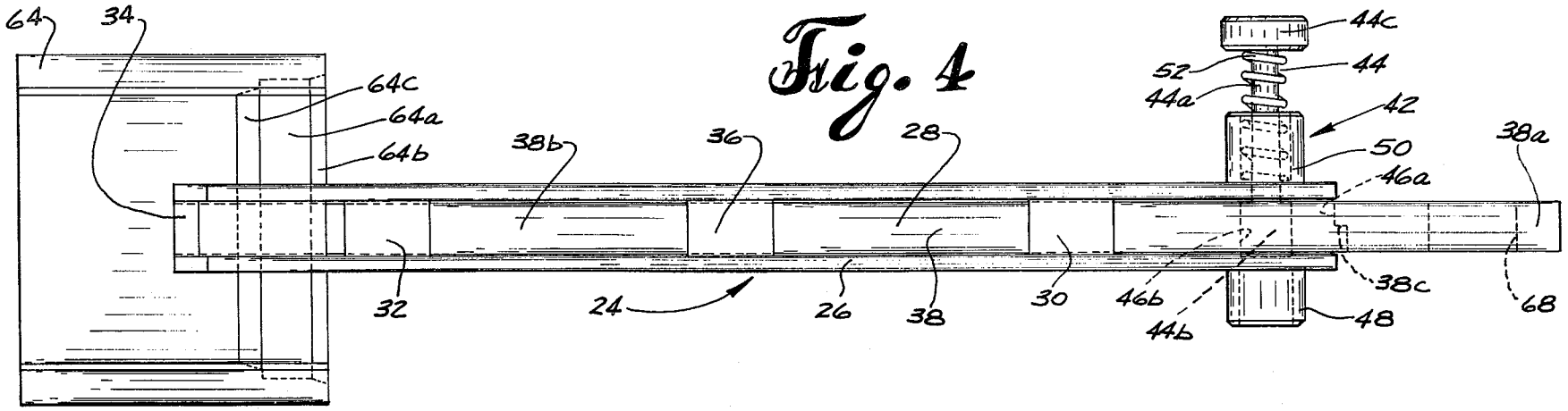
FIG. 4 is a plan view of the elevator in the closed position.
Figure 3:
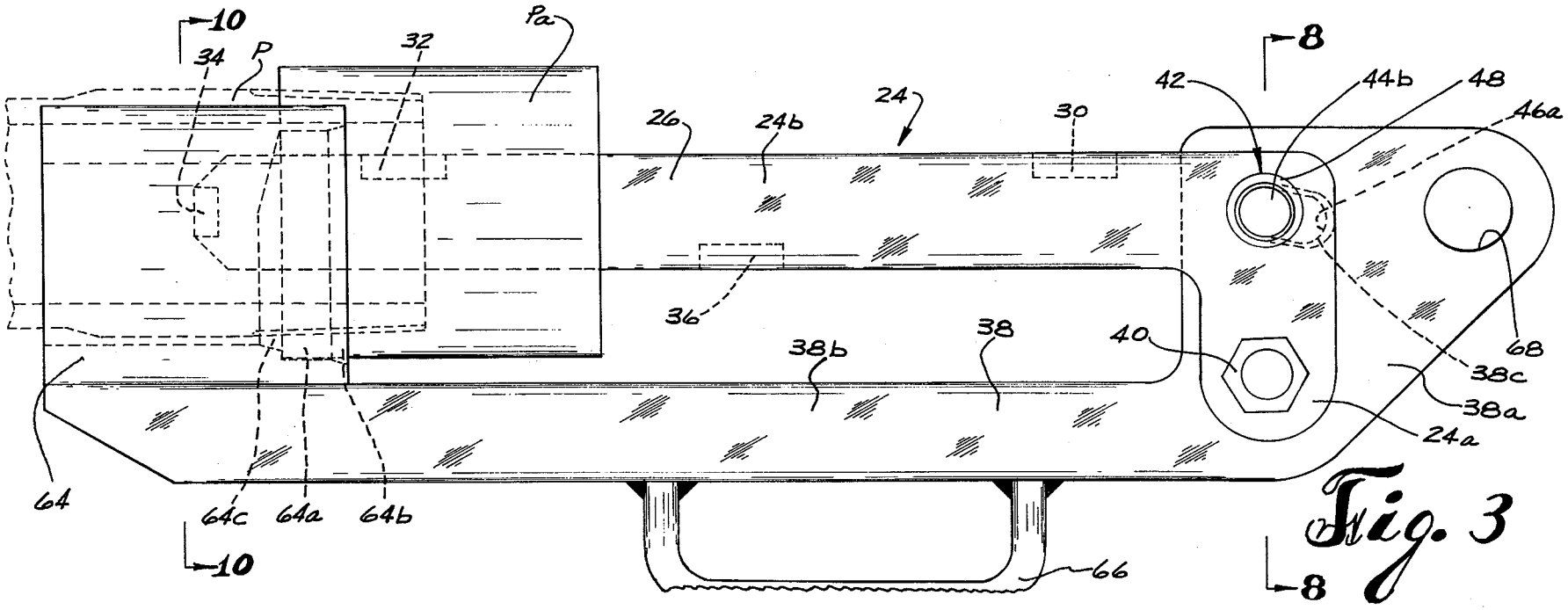
FIG. 3 is an elevation of the elevator in the closed position.
Figures 5, 6:
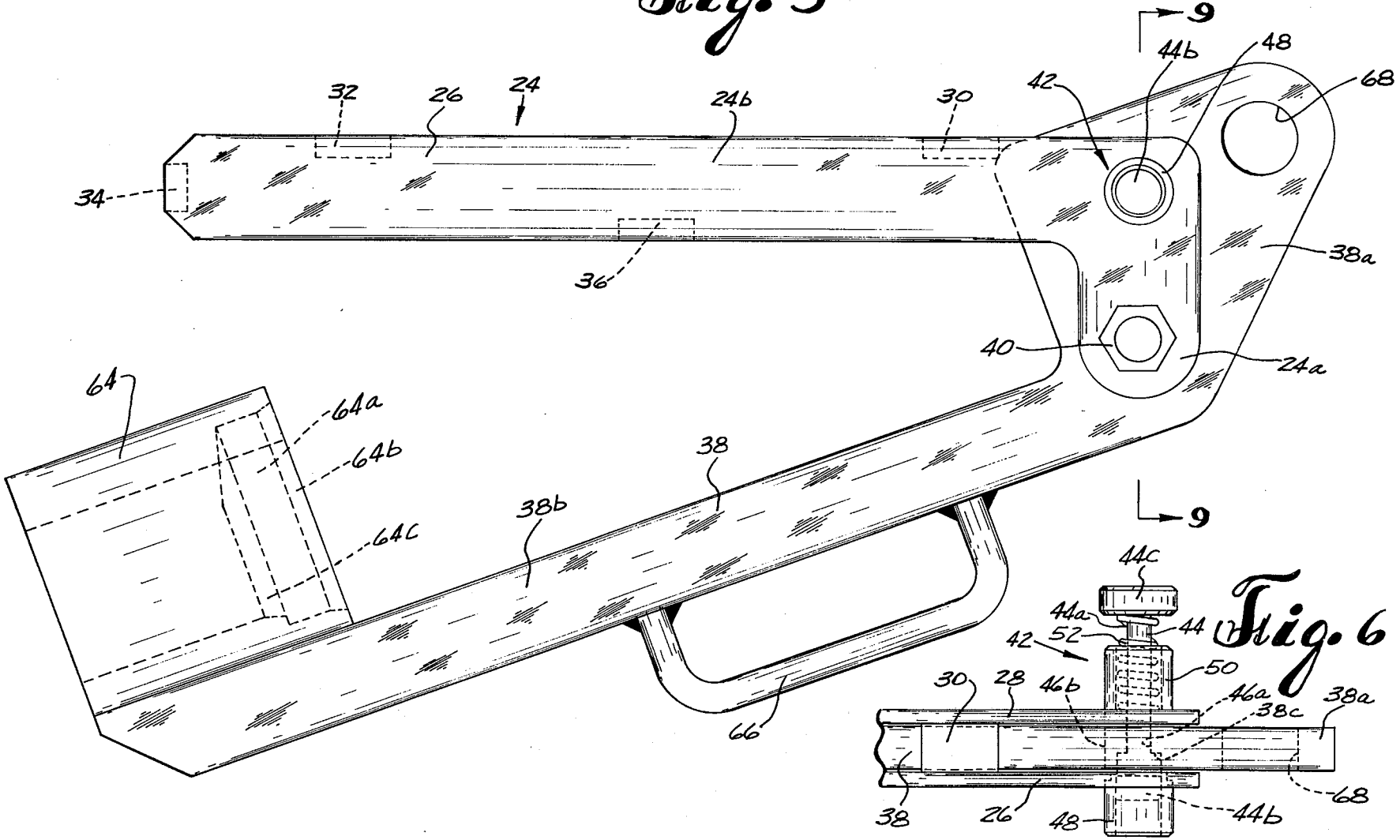
FIG. 5 is an elevation of the elevator in the open position.
FIG. 6 is a plan view of the locking device of the elevator.
Figure 7B:
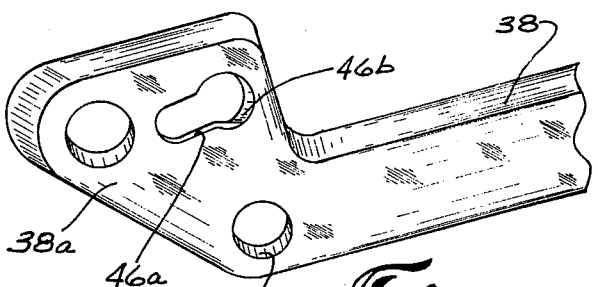
FIGS. 7A and 7B respectively show opposite sides, in perspective, of the hinge end of the cradle arm.
Figure 7A:
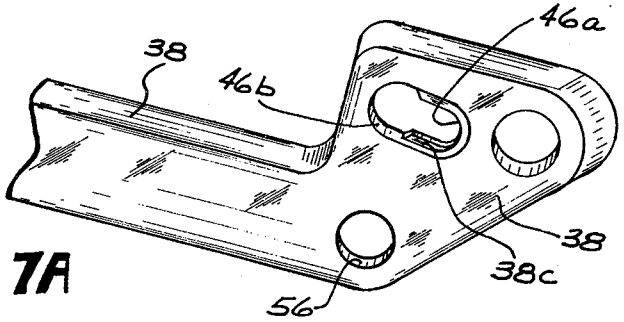

FIGS. 3, 4, and 5 show the general construction of the elevator at 10. A generally L-shaped arm at 24, having a shoulder 24*a* and a shank 24*b*, is constructed of two laminar plates 26 and 28, separated by four spacers 30, 32, 34 and 36. A second arm 38 is constructed in part from a single plate of thickness sufficiently small to allow the enlarged end, or shoulder, 38*a* of the second arm to fit between the laminar plates 26 and 28 of the first arm at 24. A shank 38*b* of the second arm 38 extends from the shoulder 38*a*. Because of their respective functions in the operation and use of the elevator, as described hereinafter, the first arm at 24 may be identified as the insertion arm, and the second arm 38 as the cradle arm. A bolt 40 serves as a hinge between the two arms 24 and 38, as will be discussed in detail hereinafter. The hinge bolt 40 joins the shoulder 38*a* of the cradle arm 38 to the shoulder 24*a* of the insertion arm 24, and permits relative rotational motion of the arms 24 and 38 between a closed position as shown in FIG. 3, in which the shank 24*b* of the insertion arm 24 is parallel to the shank 38*b* of the cradle arm 38, and an open position as shown in FIG. 5, in which the two shanks 24*b* and 38*b* are oriented in different directions with respect to each other. A lock assembly, shown generally at 42, locks the arms 24 and 38 in the closed position as shown in FIGS. 3 and 4, and defines the limit of mutual rotational movement of the arms into the open position as shown in FIGS. 5 and 6. The lock assembly at 42 functions by the selective positioning of a locking bar 44 within appropriate throughbores in the two shoulders 24*a* and 38*a*, as may be appreciated from observation of FIGS. 7A, 7B, 8 and 9. The locking bar 44 is constructed in the form of a shank 44*a*, an enlarged base 44*b*, and a flange 44*c*, all of which are cylindrical. The throughbore 46 that accommodates the locking bar 44 in the shoulder 38*a* is in the form of an elongate hole, oriented along a line running generally toward and away from the shank 38*b*. On the side of the shoulder 38*a* that faces the laminar plate 28, the throughbore 46 is in the form of a keyhole having lobes 46*a* and 46*b*, with the lobe 46*a* of the keyhole that is located generally away from the shank 38*b* being large enough for the lock bar shank 44*a* to pass through, but too small for the wider lock bar base 44*b*. The lobe 46*b* of the keyhole that is closer to the shank 38*b* is large enough to accommodate the lock bar base 44*b* as well as the lock bar shank 44*a*. On the side of the shoulder 38*a* that faces the laminar plate 26, the elongate throughbore 46 has the same lateral dimension as the lobe 46*b*, and is therefore sufficiently large along its entire extent to accommodate the lock bar base 44*b*. Consequently, the lobe 46*b* may be viewed as passing entirely through the shoulder 38*a*, while the lobe 46*a*, having a smaller lateral dimension, extends only partially through the shoulder 38*a*, ending at an internal shoulder 38*c* within the throughbore 46.

In the shoulder 24*a*, the locking bar 44 moves within a circular throughbore 26*a* in the laminar plate 26, and a similar throughbore 28*a* located in the laminar plate 28 opposite the throughbore 26*a*. A cylindrical sleeve 48 is fixed in the throughbore 26*a*, and possesses an internal diameter just large enough to accommodate the lock bar base 24*b*. A sleeve 50 is similarly fixed in the circular throughbore 28*a*, with a neck portion 50*a* having an internal diameter just sufficiently large to accommodate the lock bar shank 44*a*, but otherwise with an internal diameter sufficiently large to include a spring 52 encircling the lock bar shank between the sleeve neck 50*a* and the lock bar flange 44*c*. The spring 52 urges the locking bar 44 generally away from the laminar plate 26, thereby tending to draw the lock bar base 44*b* into the throughbore 46.

Figure 8:
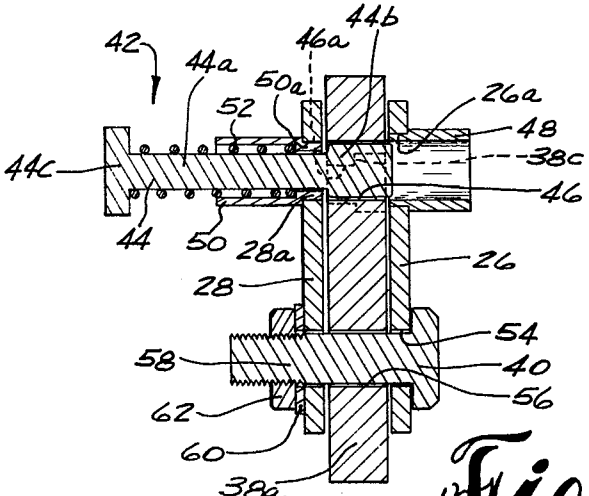
FIG. 8 is a view along the line 8—8 in FIG. 3.
Figure 9:
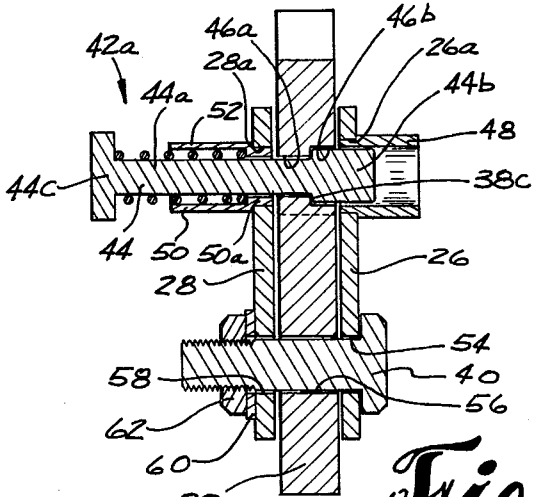
FIG. 9 is a view along the line 9—9 in FIG. 5.

The hinge bolt 40 passes through a circular throughbore 54 in the laminar plate 26, a circular throughbore 56 in the shoulder 38*a*, and a circular throughbore 58 in the laminar plate 28, and is fastened by a washer 60 and a nut 62 to form the hinge assembly about which the arms 24 and 38 rotate between the closed position shown in FIGS. 3, 4, and 8, and the open position shown in FIGS. 5, 6, and 9. When the arms 24 and 38 are in the closed position, the throughbore lobe 46*b*, which lies toward the shank 38*b* and passes completely through the shoulder 38*a*, is aligned with the sleeves 48 and 50; then, the spring 52 moves the locking bar 44 away from the sleeve 48, drawing the lock bar base 44*b* into the throughbore lobe 46*b*. It is only when the arms 24 and 38 are not in the closed position that the lock bar base 44*b* is prevented by the smaller lateral dimension of the throughbore lobe 46*a*, and the shoulder 38*c*, from passing into the throughbore 46 to a position adjacent the laminar plate 28. Consequently, when the arms 24 and 38 are in any position but the closed position, such as the open position shown in FIGS. 5, 6, and 9, the locking bar 44 must be located sufficiently toward the laminar plate 26 to allow the lock bar base 44*b* to be positioned completely on the side of the shoulder 38*c* toward the laminar plate 26. In that case, the spring 52 effectively urges the lock bar base 44*b* against the shoulder 38*c*. Therefore, as the arms 24 and 38 are moved from the open position, with the lock bar shank 44*a* located partially within the throughbore segment 46*a* as shown in FIG. 9, to the closed position, the locking bar 44 remains stationary with respect to the sleeves 50 and 48, with the spring 52 compressed, until the closed position is achieved. At that moment, the lock bar base 44*b* clears the shoulder 38*c*, and the spring 52 moves the lock bar 44 away from the sleeve 48 into the position shown in FIG. 8. In the closed position, the lock assembly at 42 thus automatically locks the arms 24 and 38 fixed with respect to each other by the positioning of the lock bar base 44*b* in the throughbore segment 46*b* and adjacent the laminar plate 28. In order for the arms 24 and 38 to separate from each other in the closed position, the locking bar 44 must be moved toward the sleeve 48 against the force of the spring 52 sufficiently far to cause the lock bar base 44*b* to clear the depth of the throughbore segment 46*a*, and the shoulder 38*c*. This motion of the locking bar 44 toward the sleeve 48 must be effected manually or by some other outside agency. Consequently, the locking assembly at 42 permits the elevator to progress from an open position to the closed position, but automatically locks the arms 24 and 38 in the closed position so that the elevator may not be returned to an open position without operation of an outside agency to unlock the arms.

It will be appreciated that, as the arms 24 and 38 are opened, the locking bar 44 moves with respect to the cradle arm 38 generally away from the shank 38*b*. Thus, when the locking bar 44 reaches the end of the throughbore 46 generally away from the shank 38*b* as shown in FIGS. 4, 6, and 9, the position of the arms 24 and 38 then obtained is the limiting open position achievable by the elevator.

FIGS. 3, 4, 5, and 10 illustrate a C-shaped receptacle, or cradle, 64 located on the end of the cradle arm 38 opposite the shoulder 38*a*. The receptacle 64 forms a trough whose internal lateral dimension is sufficiently large to enable the receptacle to be fitted about the shank of a pipe member P, but small enough to prevent the passage of a pipe member collar P*a* therethrough. A ledge 64*a* is formed within the receptacle 64 of appropriate curvature to serve as a seat for a pipe member collar P*a*. Tapered surfaces 64*b* and 64*c* are provided adjacent the ledge 64 to seat the tapered surface of an enlarged upset end of a pipe member when pipe with such an end is being manipulated.

The cradle arm 38 is fitted with a handle 66 for convenience, particularly in manipulating the elevator between the open and closed positions. Also, the cradle arm shoulder 38*a* has a throughbore 68 positioned on a line with the center line of the insertion arm shank 24*b* when the elevator is in the closed position. The throughbore 68 is a means for suspending the elevator by a cable or other device.

To begin operation of the elevator to manipulate pipe members P, the lock assembly at 42 is first put into the unlocked position shown in FIG. 9, with the elevator in the open position as exemplified by FIG. 5. The shank 24*b* of the insertion arm 24 is then inserted into the collar end of the pipe member P to be gripped. In FIG. 3, a pipe collar P*a* is shown threaded to the end of a pipe segment P (shown by dotted lines). The pipe P and collar P*a* are also shown in FIG. 10. It will be observed in FIGS. 3 and 10 that the lateral dimensions of the insertion arm shank 24*b* are sufficiently small to permit passage of the shank into the interior of the pipe member P. Once the shank 24*b* is inserted into the end of the pipe member P, the cradle arm 38 is swung on the hinge bolt 40 until the elevator is in the closed position as exemplified by FIG. 3.

It will be appreciated from FIG. 3 that, before th elevator may be placed in the closed position with the shank 24*b* inserted into the collar end of the pipe member P, the shank 24*b* must be moved sufficiently into the pipe member to allow the C-shaped receptacle 64 to clear the collar P*a;* that is, as the elevator is being closed, the receptacle 64 must be able to be swung behind the collar P*a* opposite the open end of the pipe member P, with the pipe collar P*a* extending longitudinally into the receptacle 64 no farther than the ledge 64*a*. With the elevator thus in the closed position, the locking assembly at 42 is automatically moved to the locked position as shown in FIG. 8 by the action of the compressed spring 52. Then, the receptacle 64 may not be withdrawn from around the pipe member P by rotational motion of the cradle arm 38 with respect to the insertion arm 24, and the translational motion of the elevator along the axis of the pipe member P is limited by the pipe collar P*a* being stopped by either the shoulder 38*a* of the cradle arm or the ledge 64*a* of the receptacle. Consequently, with the shank 24*b* inserted into the open end of the pipe member P, and the receptacle 64 locked in a position on the other side of the pipe collar P*a*, the elevator is joined to the pipe member P and may not be separated therefrom until the lock assembly at 42 is moved into the open position as shown in FIG. 9 to permit the cradle arm 38 to be rotated about the hinge bolt 40 to withdraw the receptacle from about the pipe member P. With the elevator thus joined to the pipe member P, the elevator may be raised by a cable or other device passing through the throughbore 68 in the shoulder 38*a*, thereby raising the pipe member P also. When it is intended that the elevator be released from the pipe member P, the lock assembly at 42 is moved into the open position as shown in FIG. 9 by manual or other outside-agency operation of the lock bar 44, and the cradle arm 38 is swung on the hinge bolt 40 to withdraw the receptacle 64 from around the pipe member P thereby allowing the pipe collar P*a* to be moved along the shank 24*b* and the elevator to be removed from the pipe member P.

It will be appreciated that the elevator of the present invention is capable of holding a pipe member P, equipped with a collar P*a*, an upset end, or any type of enlarged end, attached or integral to the pipe member, in a loose grip that permits limited motion of the pipe along the shank 24*b* as well as rotation of the pipe relative to the elevator. Therefore, in an operation that involves threading a pipe member P thus gripped and supported by the elevator at 10 as illustrated in FIG. 2, the pipe member may be rotated relative to the elevator as needed without disturbing the grip the elevator has on the pipe member.

The elevator of the present invention is of relatively simple construction, and may readily be fabricated from standard stock material. The elevator is consequently relatively inexpensive to produce and maintain, and is easy to operate. It thus performs many of the functions of other types of elevators without the complication of construction and high costs often experienced heretofore.

The foregoing disclosure and description of the invention is illustrative and explanatory thereof, and various changes in the size, shape and materials as well as in the details of the illustrated construction may be made within the scope of the appended claims without departing from the spirit of the invention.

We claim:

1. A device for manipulating tubular members comprising:

a. first arm means partially insertable into the end of said tubular member;

b. second arm means including cradle means;

c. hinge means joining said first arm means and said second arm means so that, when said first arm means is partially inserted into the end of said tubular member, said second arm means may be rotated on said hinge means generally toward said tubular member causing said cradle means to partially encircle said tubular member in a closed position, wherein said first arm means cooperates with said second arm means and said cradle means to grip said tubular member, and so that said second arm means may be rotated on said hinge means withdrawing said cradle means generally away from said tubular member to an open position to permit said first arm means to be withdrawn from within said tubular member; and d. lock means automatically actuated, whenever said second arm means is rotated on said hinge means, relative to said first arm means, to said closed position, to positively lock said second arm means and said cradle means in said closed position, and selectively disengageable, independently of motion of said second arm means relative to said first arm means, to permit said second arm means and said cradle means to be moved to said open position.

2. A device for manipulating tubular members as defined in claim 1 wherein said cradle means comprises elongate trough means for partially enveloping said tubular member in said closed position with said trough means preventing passage therethrough of an enlarged end of said tubular member when said first arm means is partially inserted into the open end of said tubular member fitted with said enlarged end and said second arm means and said cradle means are in said closed position.

3. A device for manipulating tubular members as defined in claim 1 wherein said lock means comprises:

a. bar means movable between a first position in which said second arm means and said cradle means are locked in said closed position, and a second position in which said second arm means and said cradle means may move to said open position; and b. spring means for automatically moving said bar means from said second position to said first position when said second arm means and said cradle means are moved into said closed position.

4. A device for manipulating tubular members as defined in claim 2 wherein said lock means comprises:

a. bar means movable between a first position in which said second arm means and said cradle means are locked in said closed position, and a second position in which said second arm means and said cradle means may move to said open position; and b. spring means for automatically moving said bar means from said second position to said first position when said second arm means and said cradle means are moved into said closed position.

5. A device for manipulating tubular members that are equipped with enlarged ends comprising:

a. first arm means having first shoulder means, and having first shank means of lateral dimension to fit inside said tubular member;

b. second arm means having second shoulder means, second shank means, and receptacle means, with said second shoulder means and said receptacle means at opposite ends of said second shank means, and with said receptacle means being of internal dimension to partially encircle said tubular member but smaller than the external lateral dimension of said enlarged end;

c. hinge means joining said first shoulder means with said second shoulder means so that said second arm means may be selectively moved, in relation to said first arm means, between a first position in which said receptacle means is far enough away from said first shank means to permit ingress and egress of said first shank means into and out of said tubular member, and a second position in which, with said first shank means extending within said tubular member, said receptacle means partially encircles said tubular member with said enlarged end of said tubular member located between said receptacle means and said first and second shoulder means so that said first arm means cooperates with said second arm means to limit motion of said enlarged end of said tubular member, relative to said device; and d. lock means for automatically positively locking said second arm means in said second position whenever said second arm means is moved to said second position, and which lock means is selectively releasable, independently of motion of said second arm means relative to said first arm means, to permit said second arm means to be moved out of said second position.

6. A device for manipulating tubular members with enlarged ends as defined in claim 5 wherein said lock means comprises:

a. bar means movable between a locked position, in which case said second arm means is prevented from moving out of said second position, and an open position, in which case said second arm means may be moved out of said second position; and b. spring means for automatically moving said bar means to said locked position when said second arm means is moved to said second position.

* * * * *